US008893626B2

(12) United States Patent
Berg et al.

(10) Patent No.: US 8,893,626 B2
(45) Date of Patent: Nov. 25, 2014

(54) WHEELSET TO SIDE FRAME INTERCONNECTION FOR A RAILWAY CAR TRUCK

(75) Inventors: Thomas R. Berg, St. Louis, MO (US); George Currier, Piscataway, NJ (US); Larry Hixon, Pittstown, NJ (US); Kevin McGarvey, Piscataway, NJ (US); Jason Reiling, Hillsborough, NJ (US)

(73) Assignee: STRATO, Inc., Piscataway, NJ (US)

( * ) Notice: Subject to any disclaimer, the term of this patent is extended or adjusted under 35 U.S.C. 154(b) by 127 days.

(21) Appl. No.: 13/600,693

(22) Filed: Aug. 31, 2012

(65) Prior Publication Data

US 2014/0060380 A1 Mar. 6, 2014

(51) Int. Cl.
*B61F 5/32* (2006.01)

(52) U.S. Cl.
CPC ..... *B61F 5/32* (2013.01)
USPC ..... 105/220; 105/224.1; 105/218.1; 105/225

(58) Field of Classification Search
CPC ..... B61F 5/32; B61F 5/305
USPC ..... 105/220, 223, 218.1, 222, 224.1, 225
See application file for complete search history.

(56) References Cited

U.S. PATENT DOCUMENTS

| | | | | |
|---|---|---|---|---|
| 2,465,965 | A | | 3/1949 | Cottrell |
| 2,967,915 | A | | 1/1961 | Dean |
| 3,381,629 | A | | 5/1968 | Jones |
| 3,461,814 | A | | 8/1969 | Weber |
| 3,548,755 | A | | 12/1970 | Lich |
| 3,670,660 | A | | 6/1972 | Weber |
| 3,789,770 | A | | 2/1974 | List |
| 3,844,226 | A | * | 10/1974 | Brodeur et al. ..... 105/222 |
| 3,965,825 | A | | 6/1976 | Sherrick |
| 4,003,316 | A | | 1/1977 | Monselle |
| 4,030,424 | A | | 6/1977 | Garner |
| 4,131,069 | A | | 12/1978 | List |
| 4,278,030 | A | | 7/1981 | Ahlborn |
| 4,416,203 | A | | 11/1983 | Sherrick |
| 4,483,253 | A | | 11/1984 | List |
| 4,570,544 | A | | 2/1986 | Smith |
| 4,674,412 | A | | 6/1987 | Mulcahy |
| 4,938,152 | A | | 7/1990 | List |
| 5,027,716 | A | | 7/1991 | Weber |
| 5,081,933 | A | | 1/1992 | Lapp et al. |
| 5,237,933 | A | | 8/1993 | Bucksbee |
| 5,241,913 | A | | 9/1993 | Weber |
| 5,243,920 | A | | 9/1993 | Lamson |
| 5,461,986 | A | | 10/1995 | Sarnicki |

(Continued)

OTHER PUBLICATIONS

AAR Manual of Standards and Recommended Practices, Truck Performance for Rail Cars, Specification M-976, Sep. 2010.

(Continued)

*Primary Examiner* — Mark Le
(74) *Attorney, Agent, or Firm* — Pearl Cohen Zedek Latzer Baratz LLP

(57) ABSTRACT

A railway car truck incorporating an interconnection between the side frame and bearing adapter is characterized by a low lateral spring constant relative to the longitudinal spring constant. The interconnection provides a proportional restoring force with minimal internal friction and hysteresis. In embodiments, the interconnection comprises compressed elastomeric members positioned between the thrust lug of the side frame and the bearing adapter in the longitudinal direction and a low friction interface between the roof of the pedestal jaw and the top of the bearing adapter.

16 Claims, 5 Drawing Sheets

(56) References Cited

U.S. PATENT DOCUMENTS

| | | | |
|---|---|---|---|
| 5,463,964 | A | 11/1995 | Long |
| 5,503,084 | A | 4/1996 | Goding |
| 5,509,358 | A | 4/1996 | Hawthorne |
| 5,562,044 | A | 10/1996 | Wiebe |
| 5,562,045 | A | 10/1996 | Rudibaugh |
| 5,647,283 | A | 7/1997 | McKisle |
| 5,722,327 | A | 3/1998 | Hawthorne |
| 5,735,216 | A | 4/1998 | Bullock |
| 5,746,137 | A | 5/1998 | Hawthorne |
| 5,799,582 | A | 9/1998 | Rudibaugh |
| 5,802,982 | A | 9/1998 | Weber |
| 5,832,838 | A | 11/1998 | Shaw |
| 5,893,330 | A | 4/1999 | Emery |
| 5,918,547 | A | 7/1999 | Bullock |
| 5,924,366 | A | 7/1999 | Trainer |
| 5,943,960 | A | 8/1999 | Becker |
| 6,006,674 | A | 12/1999 | Ahmadian |
| 6,035,788 | A | 3/2000 | Mau |
| 6,053,469 | A | 4/2000 | Burgarella |
| 6,092,469 | A | 7/2000 | Monsell |
| 6,102,574 | A | 8/2000 | Proschel |
| 6,119,602 | A | 9/2000 | Yoshino |
| 6,142,081 | A | 11/2000 | Long |
| 6,148,734 | A | 11/2000 | Gwinn |
| 6,178,894 | B1 | 1/2001 | Leingang |
| 6,189,456 | B1 | 2/2001 | Smith |
| 6,234,083 | B1 | 5/2001 | Tack |
| 6,347,588 | B1 | 2/2002 | Leingang |
| 6,357,360 | B1 | 3/2002 | Arnswald |
| 6,371,033 | B1 | 4/2002 | Smith |
| 6,422,155 | B1 | 7/2002 | Heyden |
| 6,439,130 | B1 | 8/2002 | Scheffel |
| 6,672,224 | B2 | 1/2004 | Weber |
| 6,817,301 | B1 | 11/2004 | Bullock |
| 6,871,598 | B2 | 3/2005 | Schaller |
| 6,874,426 | B2 | 4/2005 | Forbes |
| 6,910,426 | B2 | 6/2005 | Krishnaswami |
| 7,143,700 | B2 | 12/2006 | Forbes |
| 7,174,837 | B2 | 2/2007 | Berg |
| 7,231,878 | B2 | 6/2007 | Wike |
| 7,263,930 | B2 | 9/2007 | Pershwitz |
| 7,308,855 | B2 | 12/2007 | Van Auken |
| 7,387,074 | B2 | 6/2008 | Myers |
| 7,448,329 | B2 | 11/2008 | Muller |
| 7,497,169 | B2 | 3/2009 | Forbes et al. |
| 7,513,199 | B2 | 4/2009 | Van Auken |
| 7,527,131 | B1 | 5/2009 | Wike |
| 7,533,617 | B2 | 5/2009 | Krautzig |
| 7,739,961 | B2 | 6/2010 | East |
| 7,798,069 | B2 | 9/2010 | Aitken |
| 7,845,288 | B2 | 12/2010 | Forbes |
| 7,966,946 | B1 * | 6/2011 | Novak et al. ..... 105/218.1 |
| 8,011,306 | B2 | 9/2011 | Forbes |
| 8,047,139 | B2 | 11/2011 | Gedenk |
| 8,474,383 | B1 | 7/2013 | Berg et al. |
| 2002/0152923 | A1 | 10/2002 | Weber et al. |
| 2012/0318166 | A1 | 12/2012 | Wike |

OTHER PUBLICATIONS

International Search Report issued for International Application PCT/US13/57452 mailed Feb. 7, 2014.

International Search Report issued for International Application PCT/US13/53147 mailed Apr. 9, 2014.

* cited by examiner

WHEELSET TO SIDE FRAME INTERCONNECTION FOR A RAILWAY CAR TRUCK

BACKGROUND OF THE INVENTION

1. Field of the Invention

The invention relates to a railway car truck incorporating a novel interconnection between the wheel set and side frame.

2. Description of the Related Art

The conventional railway car truck in use in North America for several decades has been the three-piece truck, comprising a pair of parallel side frames connected by a transversely mounted bolster. The bolster is supported on the side frames by spring sets. The wheelsets of the truck are received in bearing adapters placed in leading and trailing pedestal jaws in the side frame, so that axles of the wheelsets are parallel. The bearing adapters permit slight angular adjustment of the axles. The railway car is mounted on the center plate of the bolster, which allows the truck to pivot with respect to the car. The spring sets permit the side frames to move somewhat with respect to the bolster, about the longitudinal, vertical, and transverse axes.

On straight track, a three piece truck with parallel side frames and parallel axles perpendicular to the side frames (i.e., a perfectly "square" truck) rolls without inducing lateral forces between the wheel flange and the rail. However, at high speeds, minor perturbations in the track or in the equipment can lead to a condition known as "hunting," which describes an oscillating lateral movement of the wheelsets that causes the railcar to move side-to-side on the track. Hunting may be dangerous when the oscillations attain a resonant frequency. A number of causes are implicated in hunting, and a number of solutions have been proposed in the prior art to raise the "hunting threshold," but the condition is generally thought to be improved by increasing the rigidity of the truck.

Curved track poses a different set of challenges for the standard three-piece truck. When a railway car truck encounters a turn, the distance traversed by the wheels on the outside of the curve is greater than the distance traversed by wheels on the inside of the curve, resulting in lateral and longitudinal forces between the wheel and the rail. These wheel forces cause the wheel set to turn in a direction opposing the turn. On trucks with insufficient rigidity this results in a condition variously known as "warping," "parallelogramming" or "lozenging," wherein the side frames remain parallel, but one side frame moves forward with respect to the other. The "lozenging" condition can cause increased wear on the track and equipment, increase rolling resistance, and if severe enough result in a derailment.

In order to provide the standard three-piece truck with the ability to negotiate turns, the truck is generally designed to allow a nonparallel condition of the axles during the turn, which is then recovered on straight track. This may be achieved by permitting relative movement of the bearing adapters within the pedestal jaws of the side frames.

For the purposes herein, a "bearing adapter" is a piece which fits in a pedestal jaw of a side frame. One side of the bearing adapter is curved for engagement with the roller bearing of the axle and the other side fits in the pedestal jaw. Typically, a thrust lug protrudes from the vertical side wall of the pedestal jaw, and mates with a slot on the bearing adapter to maintain the bearing adapter in place and provide limits on the range of relative movement between the bearing adapter and pedestal jaw.

In order to improve curving performance, it is known to interpose an elastomeric bearing member between the side frame and the tops of the bearing adapters. The elastomeric member permits the side frames to maintain a ninety degree relationship with the wheelsets on straight track, while on curved track allowing the wheelsets some freedom of movement to depart from a square relationship to respond to turning forces and accommodate the nonparallel condition of the axles. The elasticity of the member biases the truck to return to its square position. Various systems to securely attach elastomeric pads to the side frame pedestal jaw are described in the prior art, including U.S. Pat. No. 4,674,412, which also contains a description of the prior art related to elastomeric pads generally.

The prior art is also replete with systems for maintaining the bearing adapter securely in place in the pedestal jaw. U.S. Pat. No. 5,503,084, for example, describes a truck having a system for holding the bearing adapter in position within the pedestal jaw using tie rods running through a bore in the bearing adapter to prevent the bearing adapters from rotationally moving.

A further mechanism to permit a truck to negotiate a turn is known as a "steerable" truck, which is generally a truck that allows rotation of each wheelset about its vertical axis so that the wheelsets may take an out-of-square position with respect to a longitudinal axis of the truck. In a steerable truck, the wheelsets are joined by an arm which controls and maintains the relationship between the wheelsets. The arm is further connected to a body of the railroad car so that movement between the car body and the wheelsets is maintained in a fixed relationship. An exemplary steerable truck is disclosed in U.S. Pat. No. 3,789,770. The invention described herein may be used with steerable and non-steerable trucks.

None of the above-described prior art recognized the advantage of an interconnection providing increased stiffness in a longitudinal direction relative to a reduced spring rate laterally between the side frame and the bearing adapter to improve passive steering and reduce lozenging.

These and other objects of the invention may be achieved by various means, as described in connection with the following description of the preferred embodiments.

SUMMARY OF THE INVENTION

In one aspect, the invention is directed to a three-piece truck having an interconnection between the side frame and the bearing adapter that provides increased stiffness in a longitudinal direction relative to a reduced spring rate laterally while also providing a restoring force responsive to displacement in the longitudinal and lateral directions with minimal friction or equivalent damping.

The interconnection between the side frame and the bearing adapter provides a lateral spring constant no more than about 5,000 lb/in, preferably less than about 3,000 lb/in, and a longitudinal spring constant in a range of about 20,000 lb/in to about 40,000 lb/in, as well as a restoring force in response to an applied load, characterized by a static coefficient of friction between two sliding surfaces or equivalent damping of no more than 0.10, preferably less than 0.08.

In another aspect, the invention is a three-piece truck comprising an interconnection between the side frame and the bearing adapter providing relatively increased stiffness in a longitudinal direction and reduced spring rate laterally, and providing a restoring force between the bearing adapter and the side frame with minimal friction or equivalent damping, and further including a transom, as described in co-pending application Ser. No. 13/600,560, filed on even date herewith, and incorporated by reference in its entirety, which provides the desired rigidity to the truck longitudinally and laterally, and a softer spring rate vertically (compared to the prior art).

In another aspect, a railway car truck according to the invention comprises: first and second side frames each having a leading and trailing pedestal jaw, the side frames being in opposed relationship and parallel, and respective leading and trailing pedestal jaws on each side frame being aligned to receive transversely mounted leading and trailing wheelsets. Each wheelset is received in the pedestal jaws and comprises an axle, wheels, and roller bearings. Each pedestal jaw comprises leading and trailing side walls and a pedestal roof. A bearing adapter is received in each pedestal jaw between the roller bearing and the pedestal roof, having a curved bottom surface facing the roller bearing and a flat upper surface facing the pedestal roof. An interconnection between the bearing adapter and the side frame comprises one or more pre-biased members positioned longitudinally with respect to the side frame against the bearing adapter, providing a force between the side frame and the bearing adapter in a longitudinal direction.

In embodiments, the bearing adapter has slots on its leading and trailing sides mating with thrust lugs on the side walls of the pedestal jaw, and two pre-biased elastomeric members are provided on the pedestal side walls between the thrust lugs and the side frame. The elastomeric members provide opposing forces in the longitudinal direction, so that zero net force is exerted between the side frame and the bearing adapter on a stationary car.

The pre-biased member(s) serve to increase the spring rate between the side frame and the bearing adapter in the longitudinal direction. This is combined with a relatively reduced spring rate in the lateral direction. In embodiments, the low lateral spring rate may be achieved, for example, by providing (a) a non-elastic surface on the pedestal roof contacting the bearing adapter providing a static coefficient of friction or equivalent damping less than 0.1, preferably less than 0.08; (b) a non-elastic surface on the top of the bearing adapter contacting the pedestal roof providing a static coefficient of friction less than 0.1, preferably less than 0.08; or both (a) and (b).

DETAILED DESCRIPTION OF THE PREFERRED EMBODIMENTS

Figure 1:
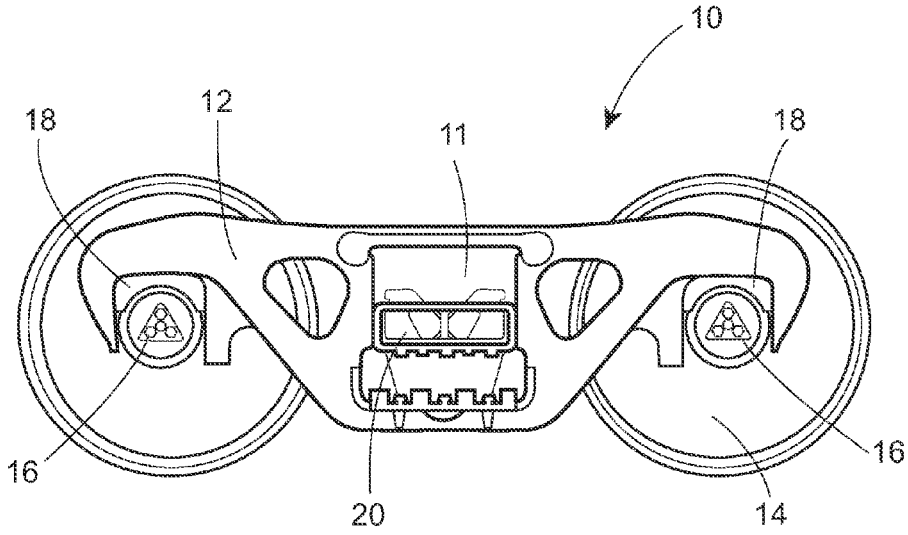
FIG. 1 is a side view of a railway car truck.

Directions and orientations herein refer to the normal orientation of a railway car in use. Thus, unless the context clearly requires otherwise, the "longitudinal" axis or direction is parallel to the rails and in the direction of movement of the railway car on the track in either direction. The "transverse" or "lateral" axis or direction is in a horizontal plane perpendicular to the longitudinal axis and the rail. The term "inboard" means toward the center of the car, and may mean inboard in a longitudinal direction, a lateral direction, or both. Similarly, "outboard" means away from the center of the car. "Vertical" is the up-and-down direction, and "horizontal" is a plane parallel to the rails including the transverse and longitudinal axes. A truck is "square" when its wheels are aligned on parallel tracks and the axles are parallel to each other and perpendicular to the side frames. The "leading" side of the truck means the first side of a truck on a railway car to encounter a turn; and the "trailing" side is opposite the leading side.

"Elastomer" and "elastomeric" refer to polymeric materials having elastic properties so that they exert a restoring force when compressed. Examples of such materials include, without limitation, natural rubber, neoprene, isoprene, butadiene, styrene-butadiene rubber (SBR), and derivatives.

"Coefficient of friction" refers to a static coefficient of friction between two surfaces. Unless the context clearly requires otherwise, a "reduced coefficient of friction" means that the coefficient of friction is reduced as compared to steel-on-steel, which is the conventional interface between the pedestal roof and the bearing adapter. "Minimal friction" is defined as a static coefficient of friction between two sliding surfaces no greater than 0.10, preferably less than 0.08. By way of comparison, the static coefficient of friction between two sliding steel surfaces is 0.40 or greater.

"Equivalent damping" refers to the calculated energy dissipation per cycle of movement, for comparing different interconnections between the bearing adapter and side frame, whether the interconnection is by way of sliding surfaces, shearing or compression of elastomeric material, or other means.

"Interconnection" between the side frame and the bearing adapter refers to any member contacting and transmitting force between the side frame and the bearing adapter.

Where a railway car truck according to the invention includes a plurality of substantially identical elements, such as two side frames, two wheelsets, four wheels, etc., it is understood that a description of one element herein serves to describe all of them.

The Association of American Railroads ("AAR") sets forth standards for railroad trucks in Standard M-976. Reference to M-976 and other AAR standards refers to the standards in effect on the filing date of this application.

The invention contemplates a variety of ways in which an interconnection may be provided between the wheelset and side frame to provide optimal and proportional spring forces to the wheelset bearing adapters. The interconnection controls relative longitudinal and lateral motion of the bearing adapters (and thereby also the wheelsets) with respect to the truck side frames to optimize steering and stability. Additionally, the interconnection provides a restoring force whereby a small movement results in a proportionally small restoring spring force with minimal friction or equivalent damping.

FIG. 1 depicts a railway car truck 10 in side view. Roller bearing 16, bearing adapter 18, wheels 14, and axle (not shown in the side view of FIG. 1), together form the wheelset. The roller bearing 16 is received against the curved surface of the bearing adapter 18 and the flat surface of the bearing adapter faces the pedestal roof 21 of the pedestal jaw (shown in FIG. 2).

Figure 2:
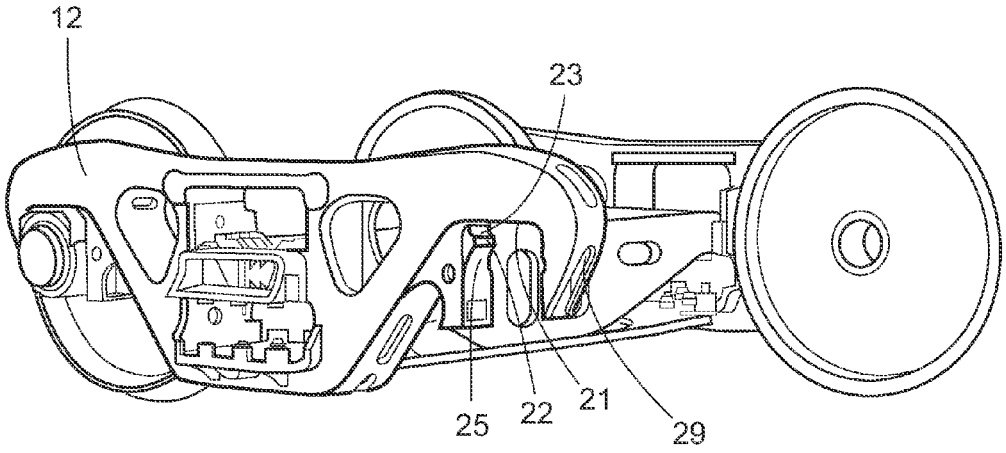
FIG. 2 is an isometric view of the railway car truck of FIG. 1, with a leading wheel and axle removed to show the pedestal jaw.

FIG. 2 depicts an isometric view of the truck of FIG. 1 with part of the wheel set removed to show thrust lug 22. Similar thrust lugs protrude from the vertical side walls of the pedestal jaw on the leading and trailing side, having a curved notch 23 adjacent the pedestal roof and a sloping lower surface 25.

Figure 4:
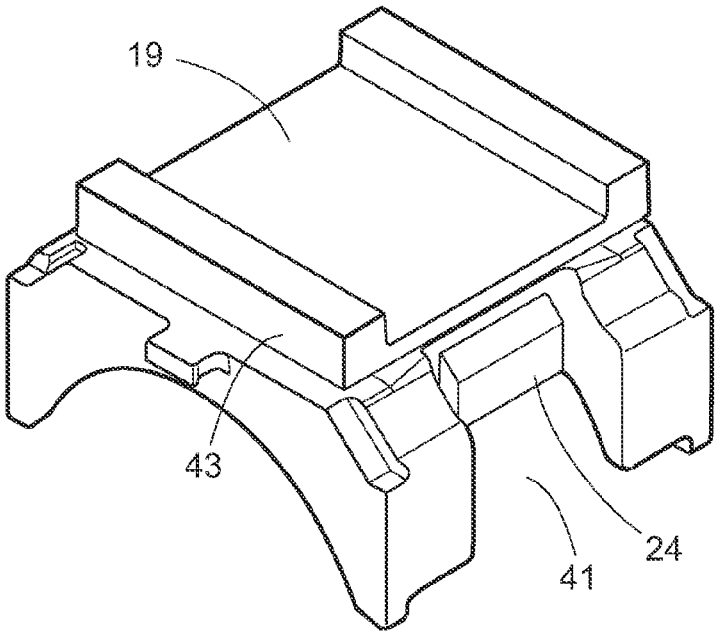
FIG. 4 is an isometric view of a bearing adapter.

FIG. 4 depicts the bearing adapter, which has slots 41 on the leading and trailing sides to mate with respective thrust lug(s) 22 on the side walls of the pedestal and prevent excessive lateral movement of the bearing adapter. The bearing adapter may utilize a plate 43. Whether with or without the plate 43, a top surface 19 of the bearing adapter contacts the pedestal roof.

Figure 3:
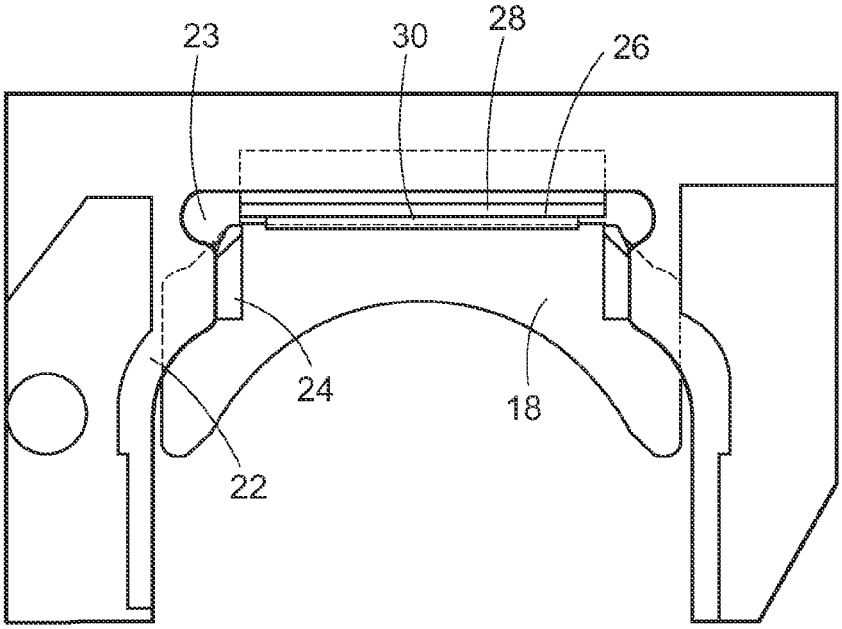
FIG. 3 is a cross-sectional view of the pedestal jaw showing pre-biased elastomeric bearing members between the side frame and the bearing adapter and modified surfaces providing an interface between the adapter and the pedestal roof.

FIG. 3 is a cross sectional view of the bearing adapter inserted into the pedestal jaw. According to one embodiment of the invention, a bias between the side frame and the bearing adapter is provided with one or more elastomeric Member(s) 24 (two such members shown in FIG. 3).

The elastomeric member(s) 24 may be made of neoprene rubber, such that inserting the elastomeric member into the slot between the bearing adapter and the thrust lug when the bearing adapter is installed compresses the member about ⅛ inch, resulting in a spring force in a range of about 500 lbs to about 1000 lbs, preferably about 750 lbs. In the embodiment shown, identical elastomeric members are similarly positioned in slots 41 on opposite longitudinal sides of the bearing adapter, so that the net force on the bearing adapter when the truck is not moving is zero. In preferred embodiments, the elastomeric members do not contact the lateral sides of the bearing adapter. In some instances, it may be desirable to provide elastomeric contact with the lateral side(s) of the bearing adapter, but still provide the interconnection with a lower lateral spring rate compared to the longitudinal spring rate.

According to the invention, an interconnection between the bearing adapter and side frame provides a lateral spring constant of no more than about 5000 lb/in, preferably less than about 3000 lb/in, while providing a longitudinal spring constant in a range of about 20,000 lb/in to about 40,000 lb/in, preferably in a range of about 25,000 lb/in to about 35,000 lb/in. The interconnection also provides a restoring force in response to an applied load, with minimal friction or equivalent damping. Preferably, the coefficient of friction between the side frame and the wheel set in response to an applied load, or the equivalent damping, is less than 0.1, or more preferably less than 0.08.

According to embodiments of the invention, the bearing adapter is engaged in the pedestal jaw with pre-biased elastomeric members, and a restoring force is provided in the longitudinal and lateral directions by the pre-biased members, with the lateral restoring force being much less than the longitudinal restoring force. For example, the force between the side frame and the bearing adapter results in a longitudinal spring rate between each bearing adapter and each side frame of about 25,000 lb/in to about 35,000 lb/in, and a lateral spring rate between the side frame and the bearing adapter is no more than 10 percent of the longitudinal spring rate.

Figure 5A:
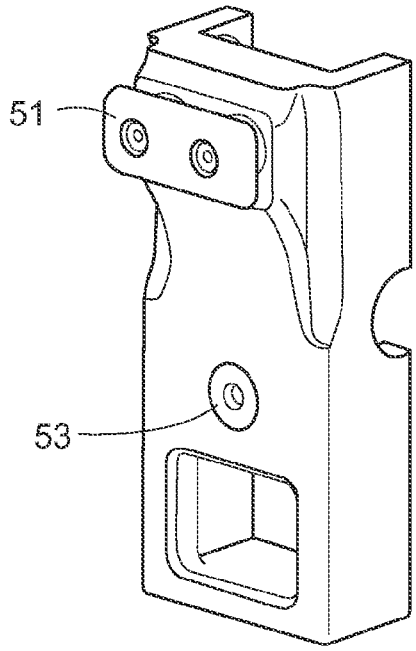
FIGS. 5A, 5B, and 5C depict various embodiments wherein a spring is mounted in a cavity behind the pedestal side wall to provide a pre-biasing force in a longitudinal direction between the side frame and the bearing adapter.
Figure 5B:
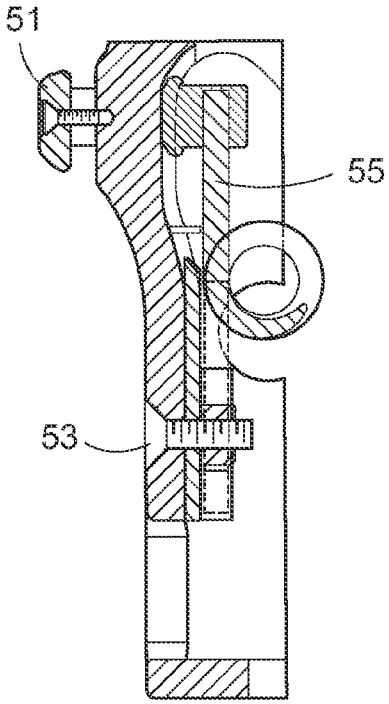
Figure 5C:
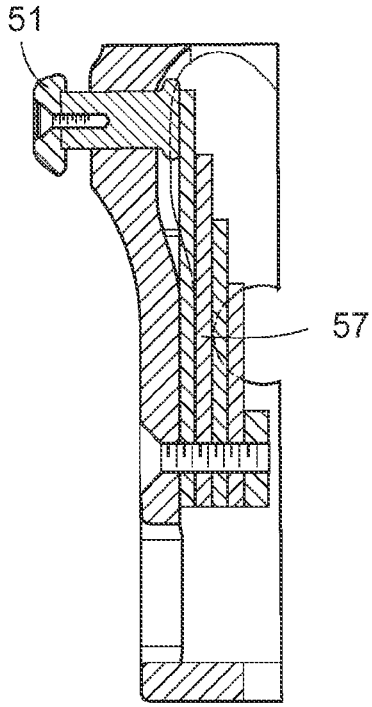

In other embodiments, shown in FIGS. 5A, 5B and 5C, one or more of the thrust lugs 22 in each pedestal jaw is fitted with a pre-biased member using a spring mounted behind the pedestal side wall. The side frame generally has pre-existing cavities 29 opposite the pedestal side walls. One or more holes are drilled in the pedestal side wall to accommodate a bolt and additional holes are drilled so that a bearing member 51 can be attached to a spring. In the cross sectional view of FIG. 5B, a torsion spring 55 is depicted having a first end secured to the pedestal wall with bolt 53 and a second end opposite said first end attached to the bearing member 51. Alternatively, a leaf spring 57 may be used, as depicted in FIG. 5C. The spring is adapted to supply a force in the longitudinal direction of about 500 lbs to about 1000 lbs, preferably about 750 lbs. As with the preceding embodiment, a spring can be mounted to both the leading and trailing pedestal side walls to provide equal and opposite force in the longitudinal direction resulting in zero net force on the bearing adapter.

In another aspect of the invention, the tolerances of the truck design may be modified so as to improve performance when combined with the pre-biased thrust lug described herein, which includes modification of the pedestal itself. A conventional pedestal has a total longitudinal gap between the bearing adapter and thrust lugs of about 0.10 inches. The inventors have found that a gap of about 0.20 to 0.25 inches permits better passive steering of the wheel sets.

Conventionally, an elastomeric pad has been provided between the pedestal roof and the top surface of the bearing adapter. A conventional elastomeric pad allows a softer spring rate in both the lateral and longitudinal directions. According to the invention, a softer spring rate is provided between the bearing adapter and the side frame in the lateral direction compared to the spring rate in the longitudinal direction. "Spring rate," in this context, refers to the amount of force needed to displace the bearing adapter a given distance relative to the side frame.

In embodiments, the truck does not include an elastomeric pad between the pedestal roof and the bearing adapter. However, it is possible to use an elastomeric pad at the pedestal roof interface in combination with the pre-biased thrust lug members and in some instances it may be desirable.

Referring again to FIG. 3, a softer lateral spring rate may also be obtained by providing a surface 30 at the top of the bearing adapter with a reduced coefficient of friction, such as Teflon® (polytetrafluoroethylene), although other known low friction materials meeting the requirements of the invention may also be suitable. A similar reduced-friction surface 28 may be provided on the pedestal roof. In the embodiment shown in FIG. 3, a low-coefficient of friction surface is provided on both surfaces, at the interface 26. Preferably, the coefficient of friction at the interface is less than about 0.08, more preferably equal to or less than about 0.04. In the example where both surfaces at the interface 26 are Teflon® the coefficient of friction is about 0.04.

In a further embodiment, a modified wheelset to side frame interconnection as described above may be combined in a truck having a transom as described in U.S. application Ser. No. 13/600,560, filed on even date herewith and incorporated by reference. The overall rigidity of the truck provided by the transom combined with the increased ratio of longitudinal to lateral spring rate provided by the bearing adapter and pedestal jaw modifications leads to a synergistic improvement in hunting threshold, angle of attack, and other critical performance parameters.

The improved performance of a truck according to the invention compared to the prior art was evaluated using a computer model. A first truck was modeled according to the invention, incorporating elastomeric members on the leading and trailing sides of the bearing adapter and Teflon® surfaces on the roof of the pedestal and on the top surface of the bearing adapter, all as described above. Additionally, the truck was modeled having a transom. The elastomeric members were modeled to apply a force of 750 lbs in opposed longitudinal directions between the side frame and the bearing adapter. The elastomeric members did not have surfaces contacting the lateral sides of the bearing adapter. The first truck was modeled to have a coefficient of friction between the pedestal roof and the bearing adapter of 0.08. To reflect the comparative performance, a current approved truck meeting the M-976 standard, having an elastomeric pad positioned between the side frame and the bearing adapter was similarly modeled.

Figure 6:
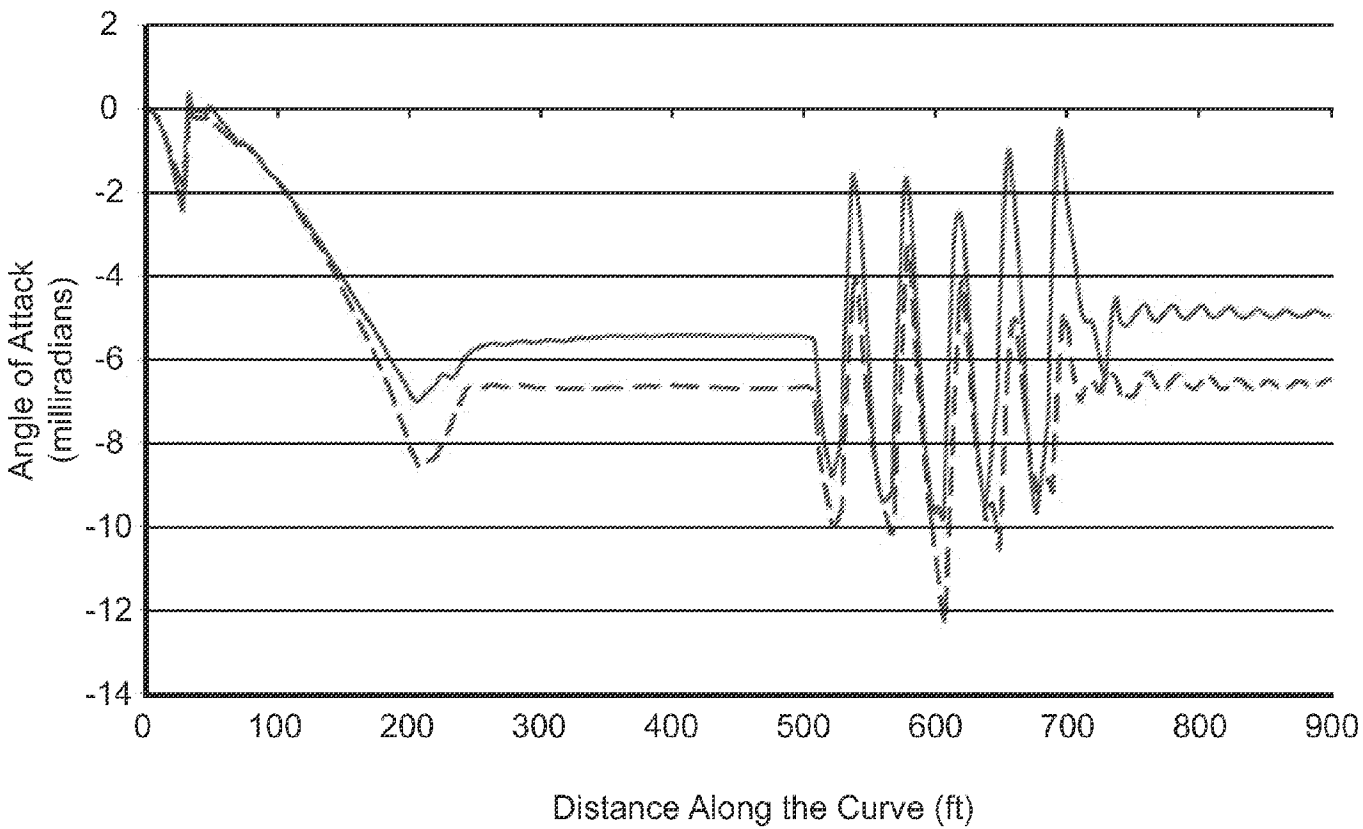
FIG. 6 is a graphic depicting the result of a computer simulation modeling the angle of attack of a truck according to the invention as it encounters curved track compared to a truck according to the prior art.

The results of the foregoing modeling are depicted in the graphic of FIG. 6, which shows a dynamic analysis of the relative angle of attack ("AOA") of the leading axle of a truck through a 900 foot long curve with typical predetermined misalignments starting at approximately 500 feet. The solid line depicts the modeled performance of a truck having both a transom and a modified bearing adapter configuration as described above, while the dashed line represents a standard truck meeting present M-976 standards. An "ideal" truck would exhibit zero AOA throughout the 900 foot curve, reflecting a perpendicular orientation of the axle and the rail throughout the turn. As seen in FIG. 6, the truck according to the invention exhibits smaller AOA displacement from zero throughout the turn compared with the truck having standard configuration.

Figure 7:
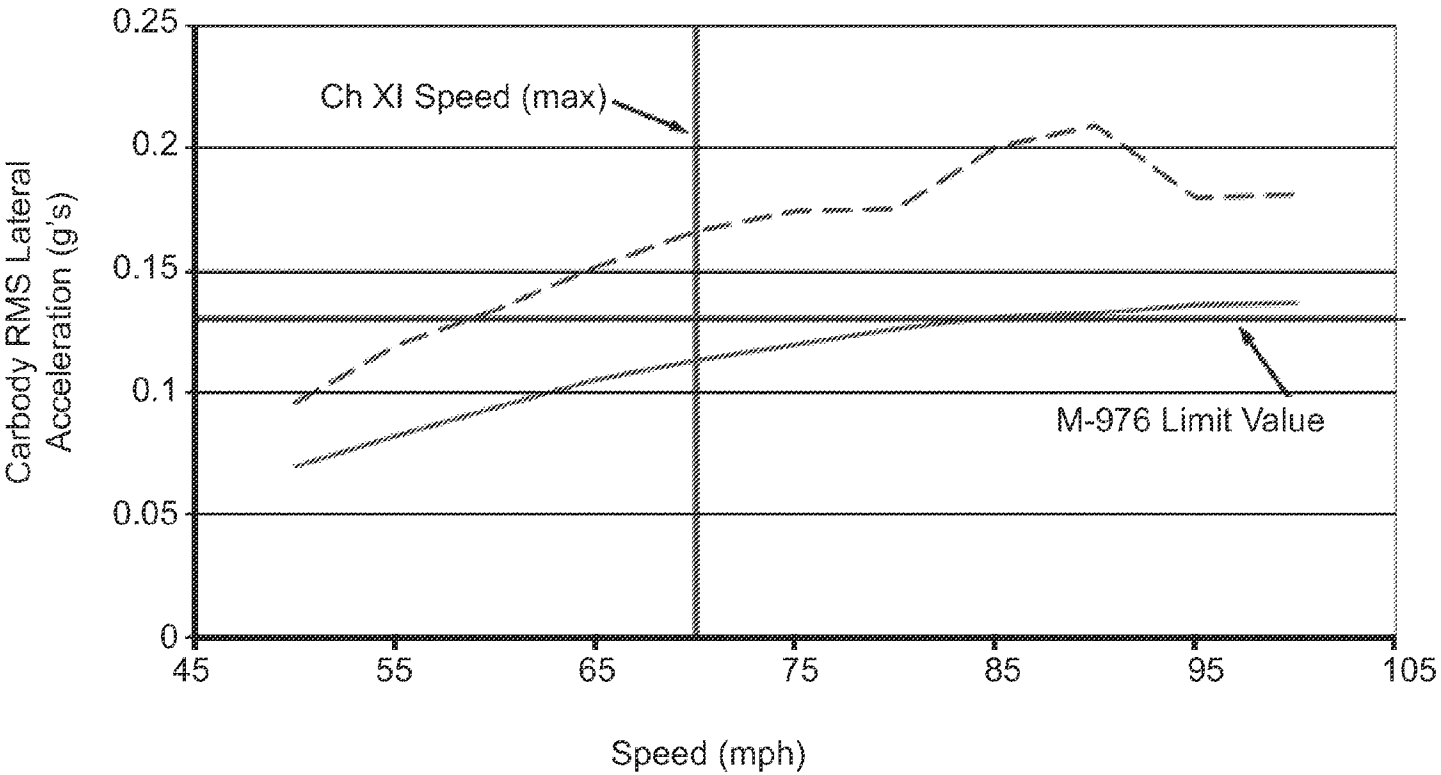
FIG. 7 is a graphic depicting the result of a computer simulation modeling RMS lateral acceleration of a railway car body as a function of car velocity, for a truck having a modified bearing adapter according to the invention as compared to a truck having a conventional interface between the bearing adapter and the pedestal jaw.

FIG. 7 depicts the modeled hunting threshold of a truck according to the invention compared with a truck modeled without the elastomeric members and reduced friction interface. The vertical axis of FIG. 7 represents the root mean square (RMS) lateral acceleration of the car body just above the point where the truck meets the car body. This lateral acceleration back and forth represents hunting behavior and is known to increase at higher speeds. AAR specifications require the specified levels to be met at velocities up to and including 70 miles per hour, indicated by the vertical line toward the center of the graphic, labeled "Ch. XI Speed (max)". This refers to Chapter XI of AAR MSRP Section C, referred to in the AAR M-976 specification. The horizontal line in the middle of FIG. 7 represents the M-976 limit value for lateral acceleration. Thus, the lower left quadrant of FIG. 7 represents trucks meeting the test requirements of the current standard.

The upper line, with data points represented by a dashed line, represents a model of a current M-976 truck without a modified side frame bearing adapter interconnection according to the invention. The lower line, with data points represented by a solid line, represents data modeled on a truck according to the invention. The truck according to the invention exhibits significantly greater resistance to hunting and a higher hunting threshold, exhibiting lateral acceleration below the M-976 limit value well above the velocity required in the current standard.

One of ordinary skill in the art will recognize that other modeling may be used to obtain information about other performance criteria, and that such performance criteria may be impacted by other components of the truck. Different trucks, each meeting the M-976 standard, may have different components. Further, the above examples reflect the combined advantages of using both the modified bearing adapter configuration described herein and the transom described in co-pending application Ser. No. 13/600,560, filed on even date herewith, and both of these modifications affect performance. Moreover, computer modeling is no substitute for testing on actual track in real world conditions, and AAR specifications require the results of such testing to be gathered over thousands of miles before a truck is approved. However, the modeling described above is commonly used and relied upon as a directional indicator of truck performance. In particular, one of ordinary skill in the art would recognize the AOA data as reflecting improvements in the pedestal jaw/bearing adapter configuration.

The description of the foregoing preferred embodiments is not to be considered as limiting the invention, which is defined according to the appended claims.

What is claimed is:

1. A railway car truck, comprising:

first and second side frames each having a leading pedestal jaw and a trailing pedestal jaw, said first and second side frames being in opposed relationship and parallel, and the leading and trailing pedestal jaws being aligned to receive transversely mounted leading and trailing wheel sets respectively;

each wheelset being received in the pedestal jaws and comprising an axle, wheels, and roller bearings;

each pedestal jaw comprising leading and trailing side walls and a pedestal roof;

a bearing adapter received in each pedestal jaw between the roller bearing and the pedestal roof, the bearing adapter having a curved bottom surface facing the roller bearing and a flat upper surface facing the pedestal roof;

an interconnection between the bearing adapter and side frame providing a lateral spring constant less than 5000 lb/in and a longitudinal spring constant between 20,000 lb/in and 40,000 lb/in, and a restoring force in response to a load applied to the truck with a coefficient of friction or equivalent damping no more than 0.1.

2. The railway car truck according to claim 1, wherein the longitudinal spring rate between each bearing adapter and each side frame is about 25,000 lb/in to about 35,000 lb/in, and the lateral spring rate between the side frame and the bearing adapter is less than 3000 lb/in.

3. The railway car truck according to claim 1, wherein the coefficient of friction between the side frame and the bearing adapter, or equivalent damping, is less than 0.08.

4. The railway car truck according to claim 1, wherein the leading and trailing side walls of the pedestal jaw each comprise a thrust lug mating with a slot on the leading and trailing sides of the bearing adapter, respectively, and comprising a pre-biased elastomeric member positioned in at least one of said slots between the thrust lug and the bearing adapter.

5. The railway car truck according to claim 1, wherein each side wall of the pedestal jaw comprises a thrust lug mating with a slot on the leading and trailing sides of the bearing adapter, respectively, and comprising a pre-biased elastomeric member positioned in each of said slots on the leading and trailing sides of the bearing adapter, providing opposed forces between the bearing adapter and the side frame in the longitudinal direction, so that zero net force is exerted between the side frame and the bearing adapter when the truck is stationary.

6. The railway car truck according to claim 4, wherein the pre-biased member provides a force in a range of about 500 lbs to about 1000 lbs between the bearing adapter and the side frame in a longitudinal direction.

7. The railway car truck according to claim 4, wherein the pre-biased elastomeric members positioned in slots on leading and trailing sides of the bearing adapter provide forces in a range of about 500 lbs to about 1000 lbs in opposite directions so that zero net force is exerted between the side frame and the bearing adapter when the truck is stationary.

8. The railway car truck according to claim 4, wherein the elastomeric member comprises neoprene rubber.

9. The railway car truck according to claim 1, further comprising: (a) a non-elastic surface on the pedestal roof contacting the bearing adapter providing a static coefficient of friction less than 0.08; (b) a non-elastic surface on the top of the bearing adapter contacting the pedestal roof providing a static coefficient of friction less than 0.08; or both (a) and (b).

10. The railway car truck according to claim 4, further comprising: (a) a non-elastic surface on the pedestal roof contacting the bearing adapter providing a static coefficient of friction less than 0.08; (b) a non-elastic surface on the top of the bearing adapter contacting the pedestal roof providing a static coefficient of friction less than 0.08; or both (a) and (b).

11. A railway car truck, comprising:

first and second side frames each having a leading pedestal jaw and a trailing pedestal jaw, said first and second side frames being in opposed relationship and parallel, and the leading and trailing pedestal jaws being aligned to receive transversely mounted leading and trailing wheel sets respectively;

each wheelset being received in the pedestal jaws and comprising an axle, wheels, and roller bearings;

each pedestal jaw comprising leading and trailing side walls and a pedestal roof;

a bearing adapter received in each pedestal jaw between the roller bearing and the pedestal roof, the bearing adapter having a curved bottom surface facing the roller bearing and flat upper surface facing the pedestal roof;

a thrust lug on each of the leading and trailing side walls of the pedestal jaw mating with respective slots on the leading and trailing sides of the bearing adapter;

compressed elastomeric members positioned between each respective thrust lug and slot providing opposed forces in the longitudinal direction on the bearing adapter when the truck is stationary; and an interface between the pedestal roof and the bearing adapter having a static coefficient of friction less than 0.08;

wherein the compressed elastomeric members and the interface between the pedestal roof and the bearing adapter provide a lateral spring constant less than 5000 lb/in and a longitudinal spring constant between 20,000 lb/in and 40,000 lb/in, and a restoring force in response to a load applied to the truck.

12. The railway car truck according to claim 11, further comprising: (a) a non-elastic surface on the pedestal roof contacting the bearing adapter providing a static coefficient of friction less than 0.08; (b) a non-elastic surface on the top of the bearing adapter contacting the pedestal roof providing a static coefficient of friction less than 0.08; or both (a) and (b).

13. The railway car truck according to claim 12, wherein the non elastic surface on the pedestal roof, on the top of the bearing adapter, or both, comprise polytetrafluoroethylene.

14. The railway car truck according to claim 11, wherein the compressed elastomeric members positioned on leading and trailing sides of the bearing adapter provide forces in a range of about 500 lbs to about 1000 lbs in opposite directions so that zero net force is exerted between the side frame and the bearing adapter when the truck is stationary.

15. The railway car truck according to claim 11, wherein the elastomeric members do not contact the lateral sides of the bearing adapter.

16. The railway car truck according to claim 11, wherein the elastomeric members each comprise neoprene rubber.

* * * * *